United States Patent [19]

Jendrichowski et al.

[11] Patent Number: 4,783,223

[45] Date of Patent: Nov. 8, 1988

[54] METHOD OF AND AN ARRANGEMENT FOR REDUCING HEAT CONSUMPTION OF BOTTLE CLEANING MACHINES

[75] Inventors: Klaus Jendrichowski, Holzwickede; Gisbert Strohn, Herdecke, both of Fed. Rep. of Germany

[73] Assignee: Holstein & Kappert GmbH, Dortmund, Fed. Rep. of Germany

[21] Appl. No.: 848,739

[22] Filed: Apr. 4, 1986

[30] Foreign Application Priority Data

Apr. 4, 1985 [DE] Fed. Rep. of Germany ..... 3512463

[51] Int. Cl.[4] ..... B67C 1/00; F24J 3/04

[52] U.S. Cl. ..... 134/30; 134/32; 134/25.4; 134/107; 134/108; 62/238.6; 62/175; 165/47

[58] Field of Search ..... 165/47; 34/60, 61; 134/105, 107, 108, 29, 30, 32, 36, 25.1, 25.2, 25.4; 62/238.6, 238.7, 175

[56] References Cited

U.S. PATENT DOCUMENTS

| | | | |
|---|---|---|---|
| 2,707,869 | 5/1955 | Dennison | 62/175 |
| 3,858,627 | 1/1975 | Hinxlage | 134/108 |
| 3,951,158 | 4/1976 | Tedden | 134/108 |
| 3,984,050 | 10/1976 | Gustafsson | 62/238.6 |
| 4,154,624 | 5/1979 | Wahl et al. | 134/25.4 |
| 4,291,757 | 9/1981 | Redden | 62/238.6 |
| 4,391,104 | 7/1983 | Wendschlag | 62/238.6 |
| 4,461,653 | 7/1984 | Ruppell | 134/108 |
| 4,512,811 | 4/1985 | Binnig et al. | 134/108 |
| 4,517,810 | 5/1985 | Foley et al. | 62/238.6 |

FOREIGN PATENT DOCUMENTS

| | | | |
|---|---|---|---|
| 0131691 | 1/1985 | European Pat. Off. | 62/238.6 |
| 2510927 | 9/1975 | Fed. Rep. of Germany . | |
| 2951204 | 6/1981 | Fed. Rep. of Germany | 165/47 |
| 3205956 | 9/1983 | Fed. Rep. of Germany . | |
| 0014034 | 1/1985 | Japan | 62/175 |

OTHER PUBLICATIONS

S. Pensel et al., Vortrag Brunnenfachgespraech, Nov. 30, 1981, pp. 68–77.

*Primary Examiner*—Albert W. Davis, Jr.
*Assistant Examiner*—John K. Ford
*Attorney, Agent, or Firm*—Michael J. Striker

[57] ABSTRACT

In accordance with a method of and arrangement for reducing heat consumption in a bottle cleaning machine, the machine has a plurality of lye solution preheating zones, a main lye solution bath, a plurality of spraying cells, and two heat pumps each having a hot side and a cold side, the hot side of one of the heat pumps being connected with one of the lye solution preheating zones while the cold side of the one heat pump is connected with at least one spraying cell, the one heat pump having an outlet connection leading to the one lye solution preheating zone and having a branching conduit leading to the cold side of another of the heat pumps and leads back to the one lye solution preheating zone, the hot side of the second heating pump having a circulating connection with the main lye solution bath.

7 Claims, 1 Drawing Sheet

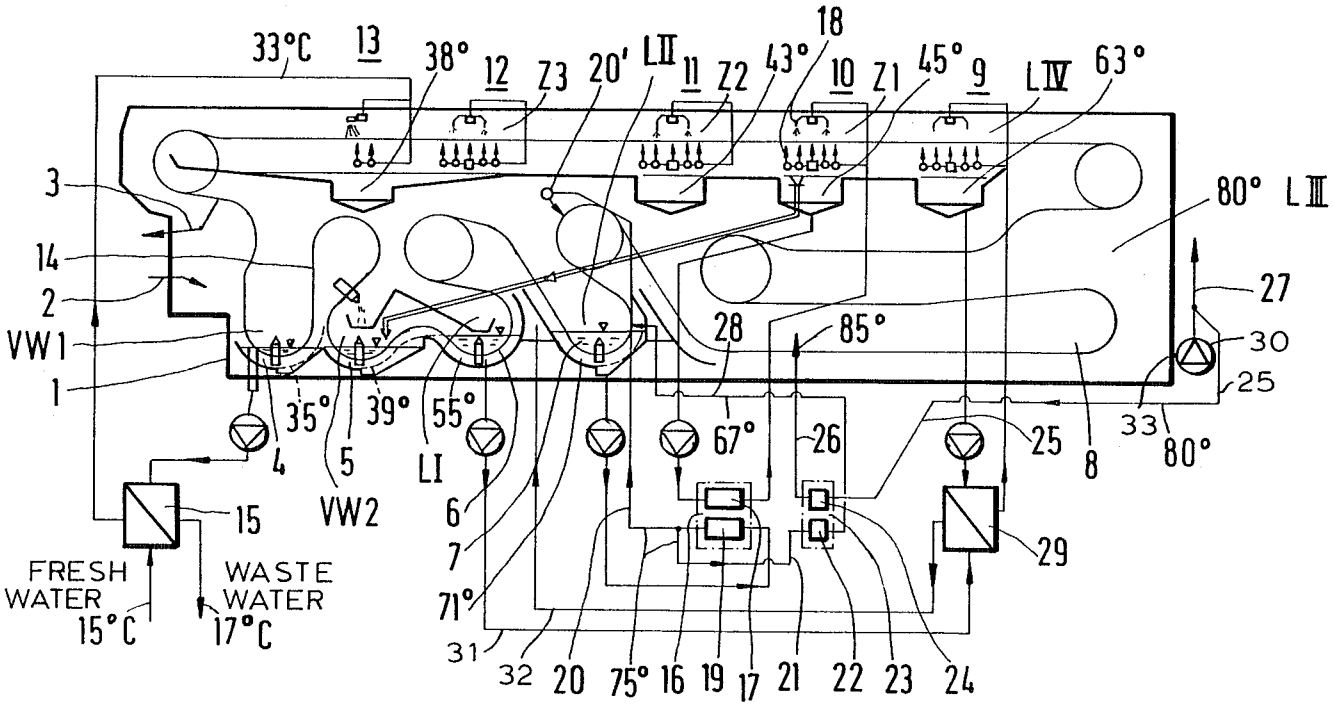
LIII
80°
27
30
25
80°
33
8
63°
LIV
9
45°
Z1
10
18
43°
Z2
11
LII
20'
Z3
12
38°
13
33°C
3
14
2
VW1
1
4
35°
39°
5
VW2
55°
LI
6
7
71°
31
32
20
75°
16
19
17
21
22
23
24
29
25
26
85°
28
67°
WASTE WATER 17°C
15
FRESH WATER 15°C

METHOD OF AND AN ARRANGEMENT FOR REDUCING HEAT CONSUMPTION OF BOTTLE CLEANING MACHINES

BACKGROUND OF THE INVENTION

The present invention relates to a method of and an arrangement for reducing heat consumption of bottle cleaning machines with use of a heat pump, in which heat quantity supplied to the last spraying cell is partially withdrawn and supplied to one of pre-heating zones.

The heat pumps have been widely used in the field of bottle cleaning machines since certain time. It was proposed in particular to use dirty water discharged from the cleaning machine for the purpose of heat recovery, especially since this waste water has a relatively high temperature level on the one hand, and the determination of a predetrmined waste water discharge temperature during supplying into open network is mandatory by law on the other hand. With the use of a heat pump-,lye solution flows at its hot side and the waste water of the cleaning machine flows at its cold side (Vortrag Brunnen-Fachgespraech, Nov. 30, 1981, Darmstadt).

In the case of the use of the discharging dirty water with respective high discharge temperature, the utilization of a heat pump is however efficient when a suitable heat quantity is withdrawn from the waste water. The temperatures must lower practically to the region of 10° C.-15° C. at the cold side of the heat pump, whereby a high temperature difference is produced between the cold side and the hot side. This high difference between the waste water end temperature and the lye solution end temperature at the hot side requires a respectively high compressor power with resulting such a low power figure of the use of heat pump which is considered as no economical. In connection with this,another approach was used in accordance with which water discharged from the first preheating device is cooled in a return cooling device by means of a heat exchanger, and added to the water, and the thus heated water of the return cooling device is cooled by means of a heat pump and again supplied to the return cooling device, while the liquid of the second pre-heating device is heated at the hot side of the heat pump.

This method is disclosed in the German document DE-OS No. 3,205,956. In accordance with the method disclosed in this document, first the waste water is cooled in the fresh water spraying zone and then supplied to the waste water channel. Here also,despite the connection of an exchanger which heats the spraying water, the temperature difference during subsequent flow through the heat pump is relatively high so that the above described disadvantages are not eliminated with this proposal as well. Moreover, in this known method a return cooling of the waste water is possible only to a small extent because of the high spraying water temperature and the pre-arranged spraying baths. Therefore, is is impossible to withdraw from the waste water the heat quantity which would be required for the purpose of an effective use of a heat pump. Moreover, in each cleaning machine there is a heat equilibrium between pre-cooling and return cooling zones so that the compressor power obtained in the proposed methods cannot be accommodated. This leads to the fact that a greater quantity of heat energy is supplied to the preheating bath (hot side), than can be taken and further supplied through the cage carriers, bottles and the like.

As a result of this, undesirable heating process takes place which finally leads to turning off of the heat pump.

In accordance with another known method of cleaning bottles and the like disclosed in the German document DE-OS No. 2,510,927, a heat pump is arranged in a separate circuit and heat is withdrawn from the return cooling zone and directly supplied into the central lye solution bath. The basic goal of this method is to provide substantially complete fresh water economy. Thereby, practically the entire return cooling energy must be supplied in the heat pump. Under consideration of a bottle output temperature of 20° C. proposed in this method, a spraying water temperature in the last zone is approximately 12° C.-15° C. In accordance with this, the heat pump operates with approximately 8° C. at the cold side and with approximately 85° C. at the hot side, including the required temperature drop in the heat exchangers. Therefore, as in the previously described methods, a relatively high temperature difference inside the heat pump circuit takes place with a resulting extremely low power figure of under 1.7 which with the conventional cooling means cannot be effective, Despite this, in this system with incorporation of the cooling load, a flow consumption of approximately 250 Kw is required in the event of a throughput in a bottle cleaning machine of approximtely 50,000 bottles per hour.

SUMMARY OF THE INVENTION

Accordingly, it is an object of the present invention to provide a method of and an arrangement for reducing heat consumption in the bottle cleaning machines, in which an incorporation of heat pump in a heat circuit of the machine is performed so that it is not necessary to consider the waste water rate, and simultaneously a specially advantageous power figure of the heat pump is guaranteed. Especially, the compressor power of the heat pump must be additionally used. It is also an object of the invention to incorporate a heat pump in a heat structure of the bottle cleaning machine so that a low temperature difference inside the heat pump circuit is provided.

In keeping with these objects and with others which will become apparent hereinafter, one feature of the present invention resides, briefly stated, in that the excess water withdrawn from a spraying cell located before the last spraying cell is supplied to the cold side of a heat pump and with reduced temperature is again supplied to the spraying cell, the lye solution of the last and/or last but one preheating zone flows through the hot side and a partial stream of the then heated lye solution is supplied to the cold side of a second heat pump and from there returned to the pre-heating zone, wherein a partial stream of the main lye solution bath flows through the heat pump at the hot side so that the excess power from the first heat pump acts for heating the lye solution supplied at higher temperature and the partial stream of the lye solution at the cold side is again withdrawn for cooling the preheating zone.

When the method is performed and the arrangement is designed in accordance with the present invention, the above disadvantages are eliminated. Particularly wth the coupling of a second heat pump,the compressor of the first heat pump is used completely. Moreover, the system steps operate thereby on the respective opposite sides (hot side and cold side) with small temperature differences. Thereby similarly effective operational mode can be achieved with extremely high power figures over 5 in the first step and over 10 in the second step. This leads to the fact that the main lye solution bath of the machine in the limiting case at certain times can be heated exclusively with the compressor power of the incorporated heat pump installation.

In accordance with the invention it is also proposed with the use of the inventive method, to heat the lye solution of at least one preheatng zone by heat discharge of one spraying cell.

In connection with the recuperation steps which are arranged for the bottles in the transporting direction, a further improvement can be obtained with respect to the efficiency. In particular, the energy consumption with the proposed method is essentially reduced. In the electrical motor operated heat pumps, a total consumption in this method can be of approximately 80 Kw with a throughput of the bottle cleaning machine of approximately 50,000 bottles per hour. A further advantage here is that the pumps incorporated for the spraying zones can also be transformed for loading the heat pump system without changes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view schematically showing a bottle cleaning machine in accordance with the present invention.

DESCRIPTION OF THE PREFERRED EMBODIMENT

An example of the embodiment of the invention disclosed here shows a sequence of different baths of a bottle cleaning machine, suitable for the system. This sequence of the baths and the arrangement of the respective spraying cells can be varied and changed in any manner within the spirit of the invention.

The cleaning machine has a housing with feeding and withdrawing devices arranged at the end sides for feeding bottles to be cleaned in the direction of the arrow 2 and for withdrawing the cleaned bottles in direction of the arrow 3. Several preheating zones 4, 5 and lye solution preheating zones 6, 7 are arranged in the housing 1 one after the other in the direction of transporting the bottles. A main lye solution bath is located at the end of the housing with a subsequent lye solution spraying cell 9 and subsequently arranged water spraying cells 10, 11 and 12. Their fresh water spraying zone 13 is located directly before the withdrawing device for the cleaned bottles from the cleaning machine. The preheating zones 4, 5 serve on the one hand for constant heating of the bottles to the temperature of the lye solution bath of approximately 80° C. Simultaneously they serve, with a respectively formed loop guide for the bottles for emptying of the bottles from residues which can be present in them. The residues advantageously are accumulated in the central zone 5 and withdrawn. The individual baths can be arranged in any sequence and size, and a respectively selected movement path of the bottles is provided along the line 14.

After leaving the preheating zones 4, 5 the bottles run in a high tempered lye solution preheating zone 6 which can be followed by a further preheating zone 7 directly before the main lye solution bath. In the zone 7 the bottles reach the temperature about 70° C. The final soft lye solution treatment of the bottles is then performed in the main lye solution bath 8 with temperatures about 80° C. After leaving the main lye solution bath 8, the bottles arrive in the region of the return cooling cells, whose temperature falls from for example 63° C. to 43° C., til the region of the water spraying cell 13 which has a bath temperature of approximately 38° C. and operates with spraying water of low amount and a temperature of approximately 33° C. For obtaining the temperature provided for bottle cooling, a heat exchanger 15 can be used. The added fresh water with approximately 15° C. flows through its secondary side and the waste water with approximately 35° C. flows through its primary side. This relatively high tempered waste water can be supplied with respective low temperature for example 17° C. to the waste water network inside the temperature region prescribed by law.

For reducing the heat consumption of such cleaning machines, a heat pump 16 is provided. Excess water from a spraying cell 10 located before the spraying cell 11 flows through a cold side 17 of the heat pump 16. The return-cooled water is again supplied to spraying nozzles 18. The lye solution of the last and/or last by one lye solution heating zone 6, 7 flows at the hot side 19 of the respective heat pump circuit. The lye solution leaving with the increased temperature the heat pump 16 is again supplied to the lye solution preheating bath 7 through conduits 20 and spraying nozzles 20'. A partial stream of this lye solution of the hot side 19 is supplied via a conduit 21 to a cold side 22 of a second heat pump 23 and flows from there again into the lye solution preheating bath 7.

A partial stream of the main lye solution bath 8 flows through a conduit 25 to the second heat pump 23 at a hot side 24. The inlet-side temperature of the lye solution amounts to approximately 80° C. and the outlet side lye solution temperature amounts to for example 85° C. This heated lye solution is supplied back via a conduit 26 to the main lye solution bath 8. Advantageously, this partial stream of the lye solution is withdrawn via a surge conduit 27 and supplied from there to the second heat pump 23. In the shown combination of the flow diagram, the excess power of the first heat pump 6 is withdrawn for heating of the lye solution guided from the main lye solution bath 8. In the corresponding manner, the portion of the lye solution supplied at the cold side is returned back via a conduit 28 into the preheating zone 7 for its cooling.

Because of the provided low temperature difference at the respective hot and cold sides of the heat pumps 16 and 23, only small compressor power is required for maintaining the temperatures necessary for the heat maintenance, especially since the forward temperatures are very high and therefore a high quantity of heat energy is produced. As long as in this system, because of certain heat conditions a change or adjustment is required, a partial stream of the lye solution can be withdrawn from the pre-heating zone before the heat pump 16 and supplied by means of the conduit 21 directly to the cold side 22 of the second heat pump 23.

A further effective improvement of the method can be achieved when for example the excess water from the lye solution spraying cell 9 is supplied through a heat exchanger 29 to the spraying nozzles again. The lye solution of the first lye solution preheating station 6 flows in this case at the secondary side of the heat exchanger. The above described method can also be performed with direct coupling of the water spraying zone 10 with the main lye solution bath 8, in which case respectively high temperature differences take place and a high energy consumption must be expected.

It will be understood that each of the elements described above, or two or more together, may also find a useful application in other types of constructions differing from the types described above.

While the invention has been illustrated and described as embodied in a method of and arrangement for reducing water consumption in bottle cleaning machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of reducing heat consumption in a bottle cleaning machine having a plurality of lye solution preheating zones, a main lye solution bath, a plurality of spraying cells, and two heat pumps each having a cold side and a hot side, the method comprising the steps of withdrawing excess water from one spraying cell located before a last spraying cell; supplying the withdrawn excess water to the cold side of one heat pump and supplying the same with a reduced temperature again to the one spraying cell; passing the lye solution of at least one of the lye solution preheating zones through the hot side of said one heat pump so as to heat the same; supplying a partial stream of the thus heated lye solution to the cold side of another heat pump and from the latter supplying the same back to the respective preheating zone; supplying a remainder of the thus heated lye solution to the respective preheating zone; and passing a partial stream from the main lye solution bath at the hot side of the other heat pump and returning the same to the main lye solution bath so that excess power from the one heat pump acts for heating the supplied lye solution to the higher temperature and the partial stream of the lye solution at the cold side of the other pump is supplied again for cooling the one preheating zone.

2. A method as defined in claim 1, wherein said step of passing the lye solution through the hot side of said one heat pump includes passing the lye solution from a last one of the lye solution preheating zones.

3. A method as defined in claim 1; and further comprising the steps of withdrawing heat from one of the spraying cells, and heating the lye solution in at least one of the lye solution preheating zones by the heat withdrawn from the spraying cell.

4. A bottle cleaning machine, comprising, a plurality of lye solution preheating zones; a main lye solution bath; a plurality of spraying cells; and two heat pumps each having a hot side and a cold side, the hot side of one of said heat pumps being fluidly connected with one of said lye solution preheating zones while the cold side of said one heat pump is fluidly connected with at least one spraying cell, said one heat pump having an outlet fluid connection leading to said one lye solution preheating zone and having a branching conduit leading to the cold side of another of said heat pumps and leads back to said one lye solution preheating zone, the hot side of said second heating pump having means for recirculating main lye solution through the hot side of the heat pump with said main lye solution bath.

5. A bottle cleaning machine as defined in claim 4, wherein said cold side of said one heat pump is fluidly connected with a second one of said spraying cells.

6. A bottle cleaning machine as defined in claim 4; and further comprising a surge conduit, said main lye solution bath has a connecting fluid conduit which leads to said hot side of said other heat pump and extends from said surge conduit.

7. A bottle cleaning machine as defined in claim 4, wherein said branching conduit is arranged downstream said one heat pump.

* * * * *